United States Patent [19]

Chaplin

[11] Patent Number: 4,570,661

[45] Date of Patent: Feb. 18, 1986

[54] HYDRAULIC FLUID SUPPLY SYSTEMS

[75] Inventor: Neale A. Chaplin, Brackla, Great Britain

[73] Assignee: Powell Duffryn Engineering Limited, Pontyclun, England

[21] Appl. No.: 701,201

[22] Filed: Feb. 13, 1985

[30] Foreign Application Priority Data

Feb. 28, 1984 [GB] United Kingdom ..... 8405177

[51] Int. Cl.[4] ..... F15B 13/09

[52] U.S. Cl. ..... 137/115; 137/596.2; 91/6; 91/420; 91/531

[58] Field of Search ..... 91/420, 6, 31, 530, 91/531, 510; 137/596.2, 115; 60/405, 486

[56] References Cited

U.S. PATENT DOCUMENTS 4,201,052 5/1980 Breeden ..... 91/461 X 4,240,255 12/1980 Benelan ..... 91/420 X

*Primary Examiner*—Alan Cohan

*Attorney, Agent, or Firm*—Young & Thompson

[57] ABSTRACT

A pump 1 supplies hydraulic fluid from a reservoir 2 to hydraulically operated equipment 4 through a main flow line 3, the fluid being returned to the reservoir 2 through a return supply line 5. If the pump 1 should fail the equipment 4 may be supplied from an independent pump unit which can be connected to flow and return lines 6, 7. Because the pump 1 has failed it will be incapable of operating a dump valve 15 so the fluid will not be fed to the reservoir 2. Should there be a blockage in the equipment 4 pressure will build up in a relief valve 13 which will therefore open to allow the fluid to pass directly to the return line 5 (or 7). If the system is to be used as a source of pressurized hydraulic fluid for another unit then a change over valve 12 will be operated to de-couple the unit 4 and allow the fluid to pass to the other unit through the auxiliary supply lines 6, 7.

5 Claims, 2 Drawing Figures

HYDRAULIC FLUID SUPPLY SYSTEMS

Figure 1:
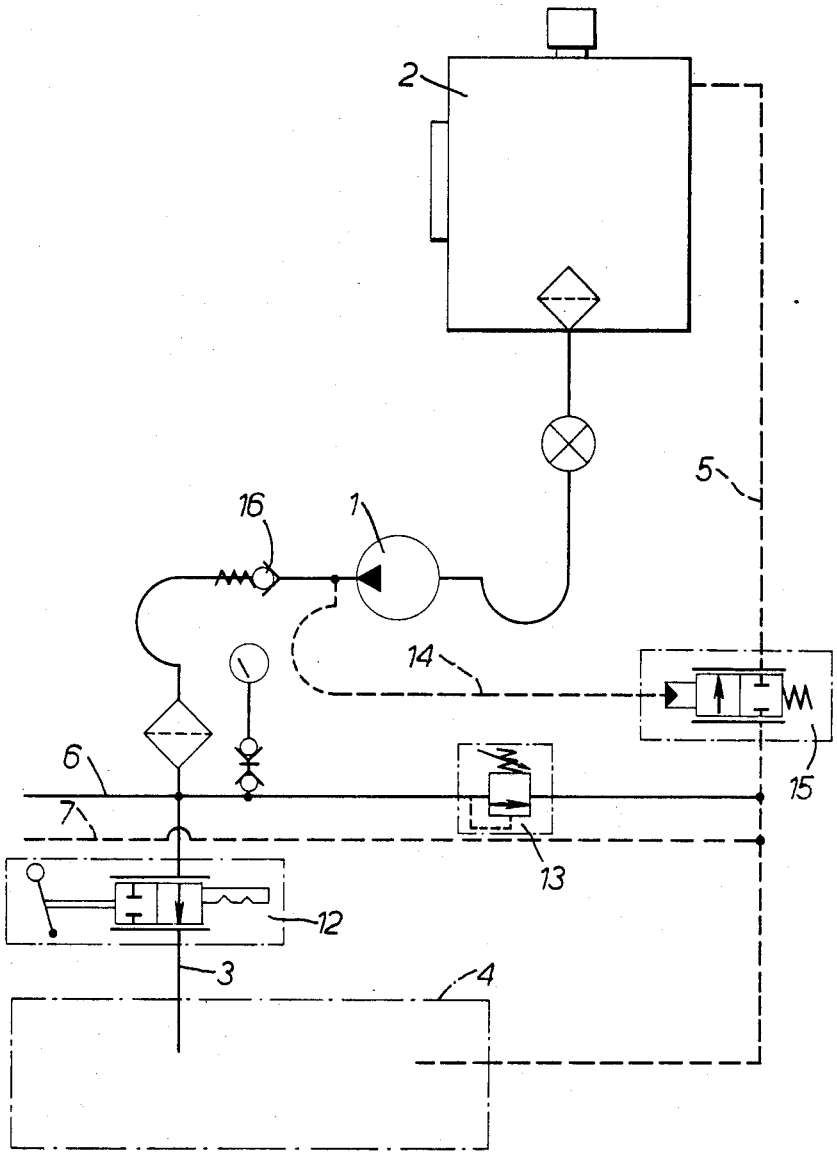

This invention is concerned particularly, though not exclusively, with a hydraulic fluid supply system for use with a vehicle carrying hydraulically operated equipment such as lifting rams. If such a vehicle should break down in the field such that the pump for supplying the pressurised hydraulic fluid becomes inoperable then the machinery cannot be used even though the rams themselves and the supply lines thereto may be undamaged.

It is an object of this invention to provide means whereby one hydraulic fluid supply system may be used to power another, comparable, damaged supply system.

Accordingly this invention provides a hydraulic fluid supply system for supplying main flow and return supply lines and auxiliary flow and return supply lines, and comprising a pump for pumping fluid from a reservoir through a check valve and then to a change over valve operable as required to allow flow through the main supply lines or only through the auxiliary supply lines, a dump valve in the return line to the reservoir which is arranged to open that return line when the pressure at the pump outlet exceeds a predetermined level, and pressure relief means for connecting the flow lines of both the main and auxiliary supply lines to the return line upstream of the dump valve.

By using such a supply system a similar damaged system can be powered through the auxiliary supply lines of another undamaged system. This is achieved by operating the change over valve so that fluid is supplied through the auxiliary supply lines of the undamaged system. The pump and reservoir of the damaged system will be closed off automatically by the check valve and dump valve so that there will be no loss of fluid through the damaged parts and the rams or other equipment of the damaged unit will operate normally, the hydraulic fluid passing back to the undamaged system through the return line thereof. The relief valve ensures that if there is any blockage in the equipment of the damaged unit resulting in a build-up of back pressure, this pressure will be relieved through the relief valve and the dump valve of the undamaged system. In normal working of a single unit the relief valve will also operate to relieve any back pressure caused by a blockage in the equipment being operated, in the normal way.

Whilst the pressure relief means could comprise independent relief valves for both the main supply lines and the auxiliary supply lines, it is more convenient to provide a single pressure relief valve which connects a common flow line portion of both the main and auxiliary supply lines to the return line to the reservoir, whilst the change over valve operates on a portion of the flow line of the main supply line, downstream of the common flow line portion, to allow or to block the flow therethrough as required.

The dump valve operational input is ideally fed from a connection between the pump and the check valve.

In the preferred arrangement the auxiliary supply lines will include quick release couplings with check valves, enabling the auxiliary supply lines of two units to be interconnected together rapidly, if necessary by means of connecting hoses.

Figure 2:
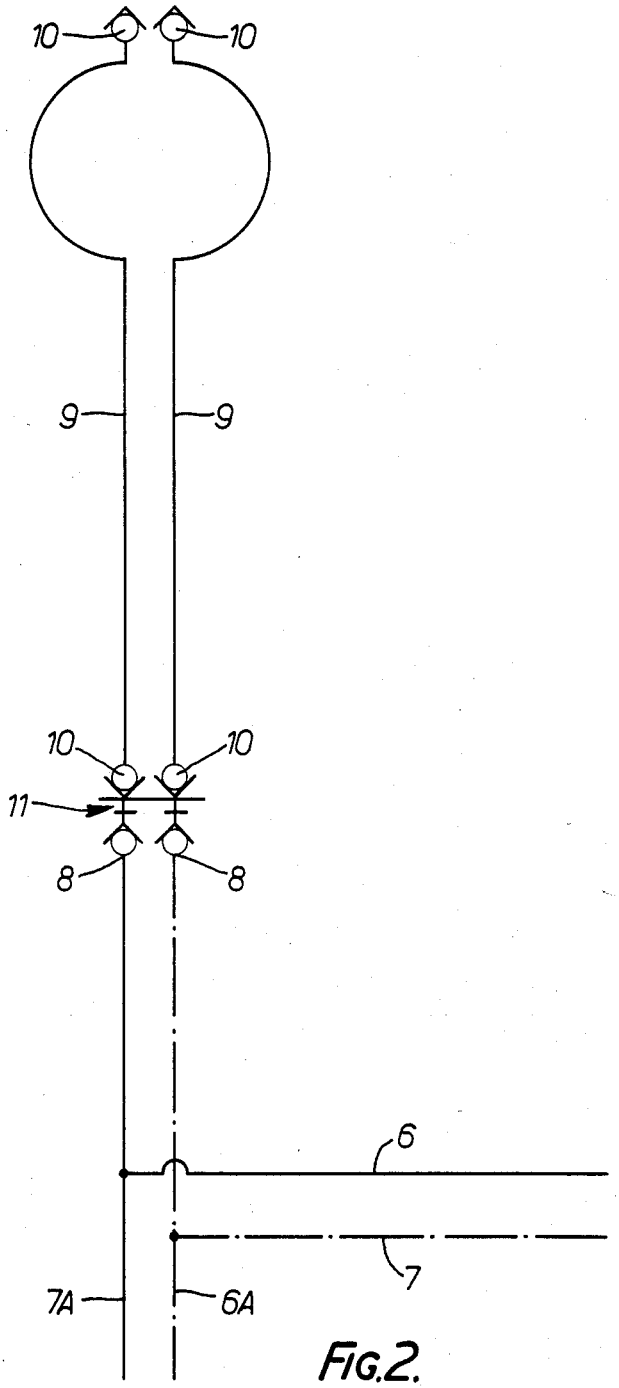

The invention may be performed in various ways and a preferred embodiment thereof will now be described with reference to the accompanying drawings, in which:

FIG. 1 illustrates the main parts of a control unit for a hydraulic fluid supply system of this invention: and FIG. 2 illustrates the interconnection of auxiliary supply lines of the supply system.

A pump 1 shown in FIG. 1 pumps pressurised hydraulic fluid from a reservoir 2, through a main flow line 3, to hydraulically operated equipment (such as hydraulic rams or a lifting mechanism) indicated by the chain line box 4. A return supply line 5 leads back to the reservoir 2. The system also incorporates auxiliary supply lines comprising a flow line 6 and a return line 7 interconnected respectively into the main flow line 3 and the main return line 5. Normally the auxiliary supply lines will be closed by check valves 8 (FIG. 2). The auxiliary supply lines may branch as at 6A and 7A leading to a further set of check valves, if desired.

The auxiliary supply lines 6 and 7 enable the pump 1 and reservoir 2 to be connected, through connecting hoses 9, to an independent supply system comparable to that shown in FIG. 1. The hoses 9 incorporate check valves 10 and may be interconnected with the auxiliary supply lines 6 and 7 by quick release couplings 11 of conventional form. Normally the two supply systems will only be interconnected if one of them is damaged such that the pump of that one is incapable of operating to supply pressurised hydraulic fluid at a required pressure to the operating unit 4. The pump 1 of the second system can then be used to supply the necessary pressurised fluid to the damaged unit. However whilst doing so it will normally be required that the equipment of unit 4 of the undamaged system should be de-coupled and this is achieved by operating a change over valve 12. If the change over valve 12 is moved to the closed position and the coupling 11 has not been made so that the check valves 8 are closed, or if there is a blockage in the damaged unit being supplied through the connecting hoses 9, then pressure will build up in the auxiliary flow line 6 of the undamaged unit and this will be relieved by a relief valve 13 set to a predetermined operating level. This enables the pressurised fluid to flow to the main return line 5 and hence back to the reservoir 2 of the undamaged system. This main return line 5 will be in an open condition because the pressurised fluid from the pump 1 is fed via a line 14 to operate a dump valve 15. However the dump valve 15 in the damaged unit will be in a closed condition because the pump 1 of that unit will not be operational and the pressurised fluid supplied from the undamaged unit will not be able to reach that line 14 as it cannot pass a check valve 16. Thus pressurised fluid from the undamaged system will not be lost to the reservoir 2 of the damaged system.

In normal operation of a single system the relief valve 13 will also act to relieve any pressure caused by a block in the equipment comprising the unit 4 fed through the main supply line 3. Again the dump valve 15 will have been operated to open the return line 5 to the reservoir 2 as pressurised fluid from the pump 1 is fed through the line 14 to the dump valve 15.

I claim:

1. A hydraulic fluid supply system for supplying main flow and return supply lines and auxiliary flow and return supply lines, and comprising a reservoir, a pump for pumping fluid from the reservoir, a check valve downstream of the pump and a change over valve operable as required to allow flow through the main supply lines or only through the auxiliary supply lines, a dump valve in the return line to the reservoir which is arranged to open that return line when the pressure at the pump outlet exceeds a predetermined level, and pressure relief means for connecting the flow lines of both the main and auxiliary supply lines to the main return line upstream of the dump valve.

2. A system according to claim 1, wherein the pressure relief means comprises a single pressure relief valve which connects a common flow line portion of both the main and auxiliary supply lines to the return line to the reservoir, and the change over valve operates on a portion of the flow line of the main supply lines, downstream of the common flow line portion, to allow or to block the flow therethrough as required.

3. A system according to claim 1, wherein the dump valve operational input is fed from a connection between the pump and the check valve.

4. A system according to claim 2, wherein the dump valve operational input is fed from a connection between the pump and the check valve.

5. A system according to claim 1, wherein the auxiliary supply lines include quick release couplings with check valves.

* * * * *